US010100652B2

(12) United States Patent
Weise

(10) Patent No.: US 10,100,652 B2
(45) Date of Patent: Oct. 16, 2018

(54) COVER PLATE FOR A ROTOR ASSEMBLY OF A GAS TURBINE ENGINE

(71) Applicant: UNITED TECHNOLOGIES CORPORATION, Hartford, CT (US)

(72) Inventor: Sarah Weise, East Hartford, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 478 days.

(21) Appl. No.: 14/781,381

(22) PCT Filed: Apr. 7, 2014

(86) PCT No.: PCT/US2014/033147
§ 371 (c)(1),
(2) Date: Sep. 30, 2015

(87) PCT Pub. No.: WO2014/168862
PCT Pub. Date: Oct. 16, 2014

(65) Prior Publication Data

US 2016/0040542 A1 Feb. 11, 2016

Related U.S. Application Data

(60) Provisional application No. 61/811,172, filed on Apr. 12, 2013, provisional application No. 61/811,171, filed on Apr. 12, 2013.

(51) Int. Cl.
*F01D 5/30* (2006.01)
*F01D 11/00* (2006.01)
*F01D 11/02* (2006.01)

(52) U.S. Cl.
CPC ..... *F01D 5/3015* (2013.01); *F01D 11/001* (2013.01); *F01D 11/02* (2013.01);
(Continued)

(58) Field of Classification Search
CPC ..... F01D 5/3015; F01D 11/001; F01D 11/02; F05D 2220/32; F05D 2260/30; F05D 2260/33
(Continued)

(56) References Cited

U.S. PATENT DOCUMENTS 3,936,216 A 2/1976 Dixon
4,473,337 A 9/1984 Leonardi et al.
(Continued)

FOREIGN PATENT DOCUMENTS

WO 2014015142 A1 1/2014
WO 2014120135 A1 8/2014

OTHER PUBLICATIONS

International Search Report and Written Opinion of the International Searching Authority for International application No. PCT/US2014/033147 dated Aug. 14, 2014.
(Continued)

*Primary Examiner* — Aaron R Eastman
(74) *Attorney, Agent, or Firm* — Carlson, Gaskey & Olds, P.C.

(57) ABSTRACT

A cover plate according to an exemplary aspect of the present disclosure includes, among other things, a body, a first tab near a bore of the body, and a second tab circumferentially spaced from the first tab. A slot is defined between the first tab and the second tab, the first tab, the second tab and the slot extending at an angle relative to a slot axis that extends through the bore. In another embodiment, the cover plate includes a bumper that limits deflection of the body.

15 Claims, 5 Drawing Sheets

(52) U.S. Cl.
CPC ..... *F05D 2220/32* (2013.01); *F05D 2260/30* (2013.01); *F05D 2260/33* (2013.01)

(58) Field of Classification Search
USPC ..... 416/220 R
See application file for complete search history.

(56) References Cited

U.S. PATENT DOCUMENTS

| | | | | |
|---|---|---|---|---|
| 4,659,285 | A | 4/1987 | Kalogeros et al. | |
| 5,472,313 | A * | 12/1995 | Quinones | F01D 5/082 415/115 |
| 5,954,477 | A | 9/1999 | Balsdon | |
| 5,993,160 | A | 11/1999 | Bouchard et al. | |
| 6,190,131 | B1 | 2/2001 | Deallenbach | |
| 8,206,119 | B2 | 6/2012 | Liotta et al. | |
| 8,277,191 | B2 | 10/2012 | Ammann | |
| 2002/0018719 | A1* | 2/2002 | Arilla | F01D 5/3015 416/220 R |
| 2005/0175459 | A1* | 8/2005 | Gagner | F01D 5/3015 416/204 R |
| 2008/0260522 | A1* | 10/2008 | Alvanos | F01D 11/001 415/173.4 |
| 2009/0004012 | A1 | 1/2009 | Caprario et al. | |
| 2009/0148295 | A1* | 6/2009 | Caprario | F01D 5/3015 416/193 A |
| 2011/0067414 | A1* | 3/2011 | Matwey | F01D 11/001 60/805 |
| 2012/0027598 | A1 | 2/2012 | Caprario | |
| 2012/0163995 | A1 | 6/2012 | Wardle et al. | |
| 2013/0004319 | A1* | 1/2013 | Lee | F01D 5/3015 416/219 R |
| 2014/0023509 | A1* | 1/2014 | Burt | F01D 5/3015 416/223 R |

OTHER PUBLICATIONS

The Extended European Search Report for EP Application No. 14783174.7, dated Nov. 23, 2016.

* cited by examiner

COVER PLATE FOR A ROTOR ASSEMBLY OF A GAS TURBINE ENGINE

BACKGROUND

This disclosure relates to a gas turbine engine, and more particularly to a cover plate for a gas turbine engine rotor assembly.

Gas turbine engines typically include at least a compressor section, a combustor section, and a turbine section. In general, during operation, air is pressurized in the compressor section and is mixed with fuel and burned in the combustor section to generate hot combustion gases. The hot combustion gases flow through the turbine section, which extracts energy from the hot combustion gases to power the compressor section and other gas turbine engine loads.

The compressor section and the turbine section may each include alternating rows of rotor and stator assemblies. The rotor assemblies carry rotating blades that create or extract energy (in the form of pressure) from the core airflow that is communicated through the gas turbine engine. The stator assemblies include stationary structures called stators that direct the core airflow to the blades to either add or extract energy.

Some rotor assemblies employ cover plates that retain the blades to disks of the rotor assemblies and seal between adjacent sets of blades and stators. A limited amount of space may be available for mounting the cover plates. These space limitations may complicate the installation and removal of the cover plates.

SUMMARY

A cover plate according to an exemplary aspect of the present disclosure includes, among other things, a body, a first tab near a bore of the body, and a second tab circumferentially spaced from the first tab. A slot is defined between the first tab and the second tab. The first tab, the second tab and the slot extend at an angle relative to a slot axis that extends through the bore.

In a further non-limiting embodiment of the foregoing cover plate, the cover plate is part of a turbine rotor assembly or a compressor rotor assembly.

In a further non-limiting embodiment of either of the foregoing cover plates, the cover plate includes a bumper that extends from an inner face of the body.

In a further non-limiting embodiment of any of the foregoing cover plates, an outer face of the first tab and the second tab is offset from an outer face of the body.

In a further non-limiting embodiment of any of the foregoing cover plates, the body includes at least one radial retention feature.

In a further non-limiting embodiment of any of the foregoing cover plates, the at least one radial retention feature extends from an inner face of the body.

In a further non-limiting embodiment of any of the foregoing cover plates, a seal land extends from the body.

In a further non-limiting embodiment of any of the foregoing cover plates, the seal land includes at least one seal that seals against a static structure adjacent to the body.

In a further non-limiting embodiment of any of the foregoing cover plates, the slot extends radially outward from a base of the first tab and the second tab.

In a further non-limiting embodiment of any of the foregoing cover plates, each of the first tab and the second tab include a gradually decreasing thickness in a direction toward a tip of each of the first tab and the second tab.

In a further non-limiting embodiment of any of the foregoing cover plates, an inner surface of the first tab and the second tab extends at the angle.

A rotor assembly of a gas turbine engine according to an exemplary aspect of the present disclosure includes, among other things, a rotor disk and at least one blade carried by the rotor disk. A cover plate is positioned on at least one of a first axial side and a second axial side of the blade. The cover plate includes at least one tab that is angled to extend away from the rotor disk.

In a further non-limiting embodiment of the foregoing rotor assembly, the cover plate includes a bumper that limits deflection of the cover plate toward the blade.

In a further non-limiting embodiment of either of the foregoing rotor assemblies, the at least one tab includes a first tab and a second tab circumferentially spaced from the first tab, and a slot is defined between the first tab and the second tab.

In a further non-limiting embodiment of any of the foregoing rotor assemblies, each of the first tab, the second tab and the slot are angled relative to an slot axis that extends through a bore of the cover plate.

A cover plate according to another exemplary aspect of the present disclosure includes, among other things, a body axially extending between an inner face and an outer face, a retaining leg that extends to an inner diameter portion of the body, a fillet that extends between the body and the retaining leg and a bumper that extends from the inner face at a location radially outward from the fillet to limit deflection of the body.

In a further non-limiting embodiment of the foregoing cover plate, the bumper is disposed on a mid-section of the body.

In a further non-limiting embodiment of either of the foregoing cover plates, the bumper is radially offset from the fillet by a distance.

In a further non-limiting embodiment of any of the foregoing cover plates, a seal land extends from the body.

In a further non-limiting embodiment of any of the foregoing cover plates, the bumper is radially between a first seal and a second seal of the seal land.

The various features and advantages of this disclosure will become apparent to those skilled in the art from the following detailed description. The drawings that accompany the detailed description can be briefly described as follows.

DETAILED DESCRIPTION

This disclosure relates to rotor assembly cover plates that retain blades to disks of the rotor assemblies and seal between adjacent sets of blades and stators. As detailed herein, among other features, the cover plates described in this disclosure are radially and circumferentially retained without reducing the effectiveness of the cover plate bores. The exemplary cover plates may be installed and/or removed from relatively tight spaces of a rotor assembly. In other embodiments, the cover plates described in this disclosure may include one or more bumpers that limit deflection of portions of the cover plate toward a rotor disk rim, thereby reducing stresses and increasing part life.

Figure 1:
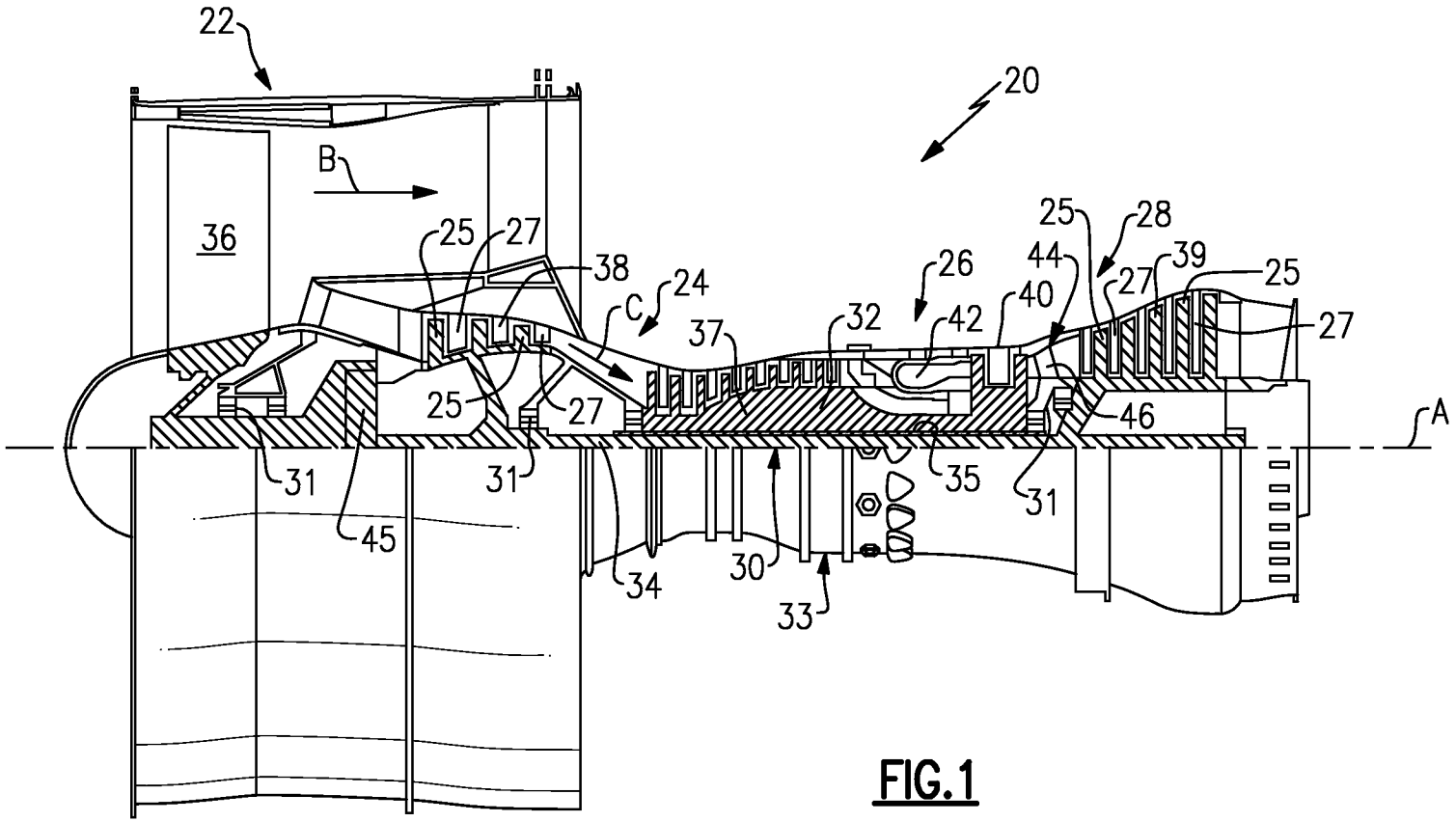
FIG. 1 illustrates a schematic, cross-sectional view of a gas turbine engine.

FIG. 1 schematically illustrates a gas turbine engine 20. The exemplary gas turbine engine 20 is a two-spool turbofan engine that generally incorporates a fan section 22, a compressor section 24, a combustor section 26 and a turbine section 28. Alternative engines might include an augmenter section (not shown) among other systems for features. The fan section 22 drives air along a bypass flow path B, while the compressor section 24 drives air along a core flow path C for compression and communication into the combustor section 26. The hot combustion gases generated in the combustor section 26 are expanded through the turbine section 28. Although depicted as a turbofan gas turbine engine in the disclosed non-limiting embodiment, it should be understood that the concepts described herein are not limited to turbofan engines and these teachings could extend to other types of engines, including but not limited to, three-spool engine architectures.

The gas turbine engine 20 generally includes a low speed spool 30 and a high speed spool 32 mounted for rotation about an engine centerline longitudinal axis A. The low speed spool 30 and the high speed spool 32 may be mounted relative to an engine static structure 33 via several bearing systems 31. It should be understood that other bearing systems 31 may alternatively or additionally be provided.

The low speed spool 30 generally includes an inner shaft 34 that interconnects a fan 36, a low pressure compressor 38 and a low pressure turbine 39. The inner shaft 34 can be connected to the fan 36 through a geared architecture 45 to drive the fan 36 at a lower speed than the low speed spool 30. The high speed spool 32 includes an outer shaft 35 that interconnects a high pressure compressor 37 and a high pressure turbine 40. In this embodiment, the inner shaft 34 and the outer shaft 35 are supported at various axial locations by bearing systems 31 positioned within the engine static structure 33.

A combustor 42 is arranged between the high pressure compressor 37 and the high pressure turbine 40. A mid-turbine frame 44 may be arranged generally between the high pressure turbine 40 and the low pressure turbine 39. The mid-turbine frame 44 can support one or more bearing systems 31 of the turbine section 28. The mid-turbine frame 44 may include one or more airfoils 46 that extend within the core flow path C.

The inner shaft 34 and the outer shaft 35 are concentric and rotate via the bearing systems 31 about the engine centerline longitudinal axis A, which is co-linear with their longitudinal axes. The core airflow is compressed by the low pressure compressor 38 and the high pressure compressor 37, is mixed with fuel and burned in the combustor 42, and is then expanded over the high pressure turbine 40 and the low pressure turbine 39. The high pressure turbine 40 and the low pressure turbine 39 rotationally drive the respective high speed spool 32 and the low speed spool 30 in response to the expansion.

The pressure ratio of the low pressure turbine 39 can be pressure measured prior to the inlet of the low pressure turbine 39 as related to the pressure at the outlet of the low pressure turbine 39 and prior to an exhaust nozzle of the gas turbine engine 20. In one non-limiting embodiment, the bypass ratio of the gas turbine engine 20 is greater than about ten (10:1), the fan diameter is significantly larger than that of the low pressure compressor 38, and the low pressure turbine 39 has a pressure ratio that is greater than about five (5:1). It should be understood, however, that the above parameters are only exemplary of one embodiment of a geared architecture engine and that the present disclosure is applicable to other gas turbine engines, including direct drive turbofans.

In this embodiment of the exemplary gas turbine engine 20, a significant amount of thrust is provided by the bypass flow path B due to the high bypass ratio. The fan section 22 of the gas turbine engine 20 is designed for a particular flight condition—typically cruise at about 0.8 Mach and about 35,000 feet. This flight condition, with the gas turbine engine 20 at its best fuel consumption, is also known as bucket cruise Thrust Specific Fuel Consumption (TSFC). TSFC is an industry standard parameter of fuel consumption per unit of thrust.

Fan Pressure Ratio is the pressure ratio across a blade of the fan section 22 without the use of a Fan Exit Guide Vane system. The low Fan Pressure Ratio according to one non-limiting embodiment of the example gas turbine engine 20 is less than 1.45. Low Corrected Fan Tip Speed is the actual fan tip speed divided by an industry standard temperature correction of $[(\text{Tram}°\text{R})/(518.7\ °\text{R}]^{0.5}$. The Low Corrected Fan Tip Speed according to one non-limiting embodiment of the example gas turbine engine 20 is less than about 1150 fps (351 m/s).

The compressor section 24 and the turbine section 28 may include alternating rows of rotor assemblies and stator assemblies (shown schematically) that carry airfoils. For example, rotor assemblies carry a plurality of rotating blades 25, while stator assemblies carry stationary stators 27 (or vanes) that extend into the core flow path C to influence the hot combustion gases. The blades 25 create or extract energy (in the form of pressure) from the core airflow that is communicated through the gas turbine engine 20 along the core flow path C. The stators 27 direct the core airflow to the blades 25 to either add or extract energy.

Figure 2:
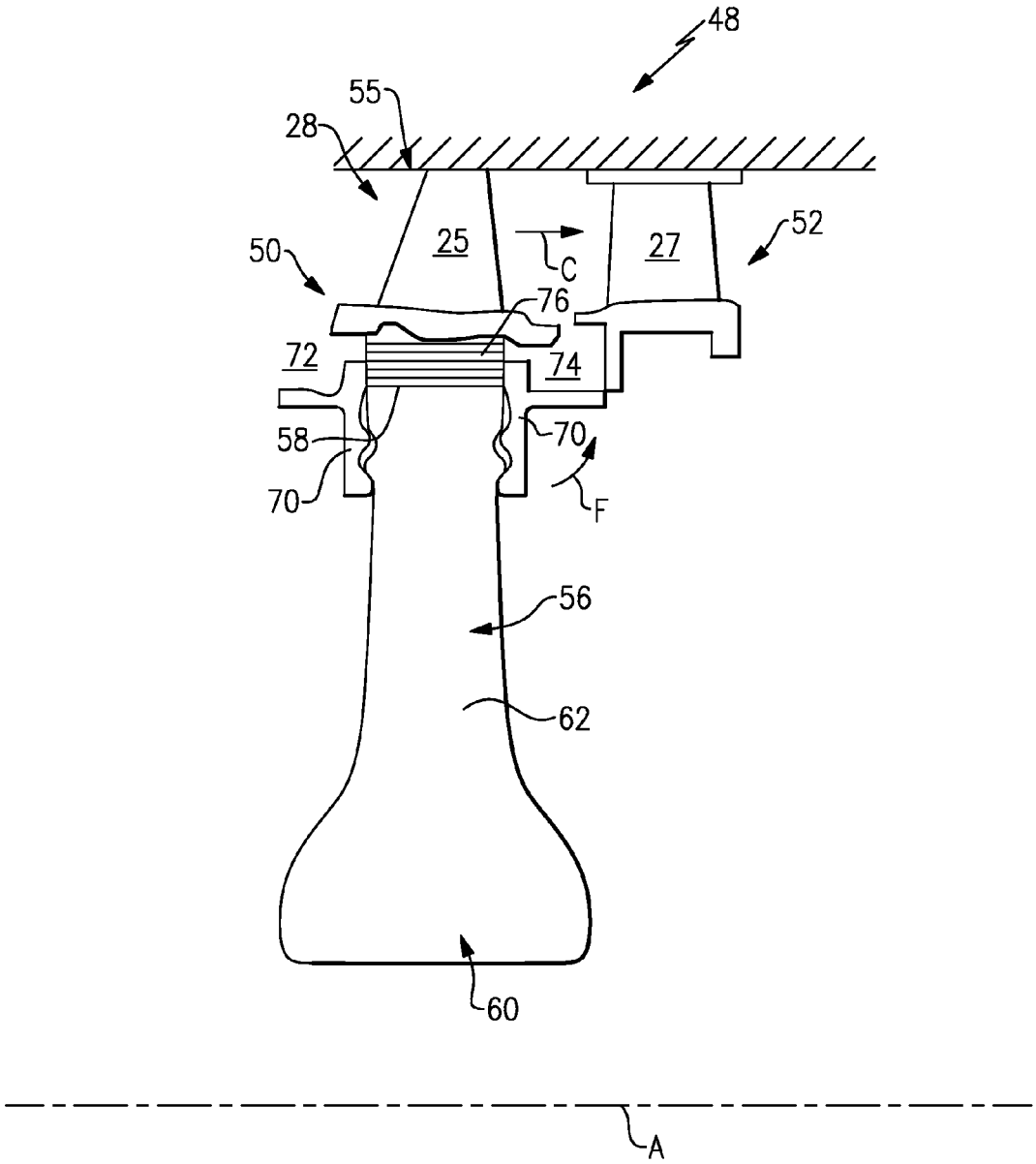
FIG. 2 illustrates a cross-sectional view of a portion of a gas turbine engine.

FIG. 2 illustrates a portion 48 of a gas turbine engine, such as the gas turbine engine 20 of FIG. 1. In this embodiment, the portion 48 is part of a turbine section 28 of the gas turbine engine 20. However, this disclosure is not limited to the turbine section 28, and the various features of this disclosure could extend to other sections of the gas turbine engine 20, including but not limited to the compressor section 24. The portion 48 is not necessarily drawn to scale and has been enlarged to better illustrate its various features and components.

In one embodiment, the portion 48 includes a rotating rotor assembly 50 and a stationary stator assembly 52. Of course, additional stages of rotor and stator assemblies than are shown may be employed within the portion 48. The rotor assemblies 50 carry blades 25, while the stator assemblies 52 carry stators 27. Each row of blades 25 and stators 27 is circumferentially disposed about the engine centerline longitudinal axis A.

The blades 25 of the rotor assembly 50 are circumferentially disposed about a rotor disk 56 that rotates about the engine centerline longitudinal axis A to move the blades 25. The rotor disk 56 includes a rim 58, a bore 60 and a web 62 that extends between the rim 58 and the bore 60. The blades 25 extend outwardly from the rim 58 of the rotor disk 56 toward an engine casing 55.

A cover plate 70 (shown schematically in FIG. 2) may be positioned on one or both of a first axial side 72 (i.e., an upstream side) and a second axial side 74 (i.e., a downstream side) of the rotor disk 56. The cover plates 70 partially extend along a root 76 of each blade 25, in one embodiment. The cover plates 70 axially retain the blades 25 to the rotor disk 56, such as within slots (not shown) formed in the rim 58 of the rotor disk 56.

In addition to providing blade retention, the cover plates 70 may form an annular seal between the core flow path C and a secondary cooling flow path F that is radially inward from the core flow path C. The secondary cooling flow path F communicates cooling fluid to cool portions of the rotor assembly 50, including but not limited to the rim 58, the bore 60, and the web 62 of the rotor disk 56.

Figure 3:
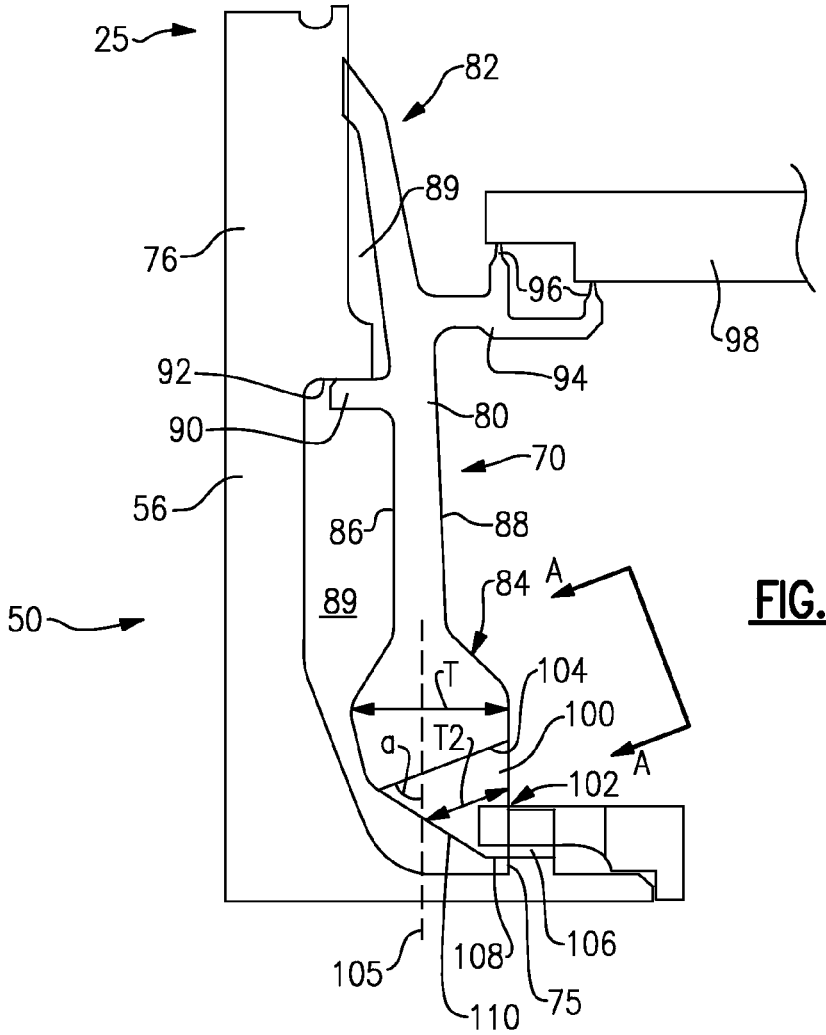
FIG. 3 illustrates a cover plate for a rotor assembly of a gas turbine engine.

FIG. 3 illustrates one exemplary cover plate 70 that may be incorporated into a rotor assembly 50. The cover plate 70 includes a body 80 that radially extends between a radially outer portion 82 and a bore 84. In one embodiment, the body 80 is an annular structure (i.e., a full ring hoop). The bore 84 is generally opposite the radially outer portion 82 (i.e., at a radially inner section of the body 80). The bore 84 may include a thickness T that is a greater thickness than the remaining portions of the body 80 of the cover plate 70.

The body 80 axially extends between an inner face 86 (which faces toward the blade 25 and the rotor assembly 50) and an outer face 88 (which faces away from the rotor assembly 50). Cavities 89 may extend between the inner face 86 of the cover plate 70 and a root 76 of a blade 25 or a rotor disk 56 of the rotor assembly 50.

The cover plate 70 may include one or more radial retention features 90 that limit radial deflection between the cover plate 70 and the rotor disk 56 of the rotor assembly 50. In one embodiment, the cover plate 70 includes a radial retention feature 90. The cover plate 70 could include additional retention features. The radial retention feature 90 extends from the inner face 86 and engages inner diameter surface 92 of the rotor disk 56 to provide radial interference between the cover plate 70 and the rotor disk 56.

The cover plate 70 may additionally include a seal land 94 that axially extends from the outer face 88 of the body 80. The seal land 94 includes one or more seals 96, such as knife edge seals, that seal relative to a static structure 98. In one embodiment, the static structure 98 is part of an adjacent stator assembly (see, for example, the stator assembly 52 of FIG. 2). The seal land 94 is radially outward of the radial retention feature 90, in one embodiment.

Figure 4:
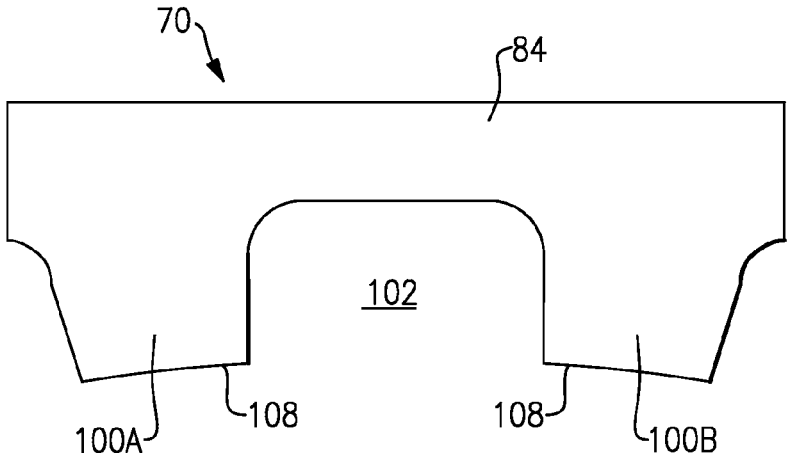
FIG. 4 illustrates a cross-sectional view through section A-A of FIG. 3.

Referring to FIGS. 3 and 4, a plurality of tabs 100 are circumferentially spaced about the bore 84 of the cover plate 70. For example, the bore 84 may include a first tab 100A, a second tab 100B circumferentially spaced from the first tab 100A, and a slot 102 defined between the tabs 100A, 100B (best shown in FIG. 4). In one embodiment, the cover plate 70 includes twenty-two slots 102. However, the number of tabs and slots of the cover plate are not intended to limit this disclosure and may vary depending upon the size and configuration of the rotor assembly 50, among other factors.

The tabs 100 and the slots 102 extend at an angle $\alpha$ relative to a slot axis 104 that extends through the bore 84 (see FIG. 3). In one embodiment, the angle $\alpha$ extends between the slot axis 104 and a radial axis 105 of the bore 84. An inner surface 110 of the tabs 100 may also be angled. The angle $\alpha$ could be any angle. The tabs 100 and slots 102 are angled so that the cover plate 70, and in particular the outer face 88 of the body 80, can clear disk tabs 106 that extend from the rotor disk 56 during installation and removal of the cover plate 70 relative to the rotor assembly 50. In one embodiment, an outer face 75 of the tabs 100 is offset from the outer face 88 of the body 80.

The tabs 100 may include a gradually decreasing thickness T2 in a direction toward a tip 108 of each tab 100. The gradually decreasing thickness T2 is established, at least in part, by the angled inner surface 110 of the tabs 100.

In one embodiment, the slots 102 extend radially into the bore 84 of the cover plate 70 (see FIG. 4). A portion of the slot 102 may extend radially outward of the tabs 100.

Figure 5:
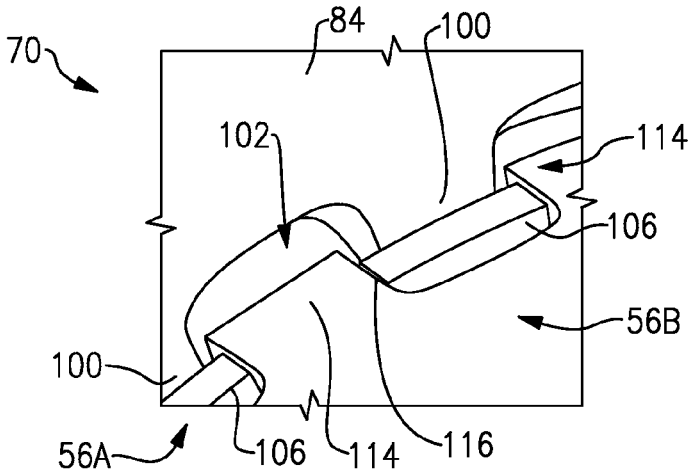
FIG. 5 illustrates additional features of a cover plate.

FIG. 5 illustrates an exemplary mounting scheme of the cover plate 70 relative to a first rotor disk 56A and a second rotor disk 56B. For example, the second rotor disk 56B may be part of another rotor assembly positioned downstream from the rotor assembly 50. The angled tabs 100 provide clearance for bayoneting the cover plate 70 onto the rotor disk 56A over the disk tabs 106. The tabs 100 of the cover plate 70 engage the disk tabs 106 to axially retain the cover plate 70.

Disk tabs 114 of the second rotor disk 56B extend through the first rotor disk 56A and into the slots 102 defined between the tabs 100 of the cover plate 70. In one embodiment, the disk tabs 114 extend through slots 116 between the disk tabs 106 of the first rotor disk 56A. Extension of the disk tabs 114 into the slots 102 circumferentially retains the cover plate 70 relative to the rotor assembly 50. In other words, the cover plate 70 is prevented from rotating relative to the rotor assembly 50 during engine operation.

Figure 6:
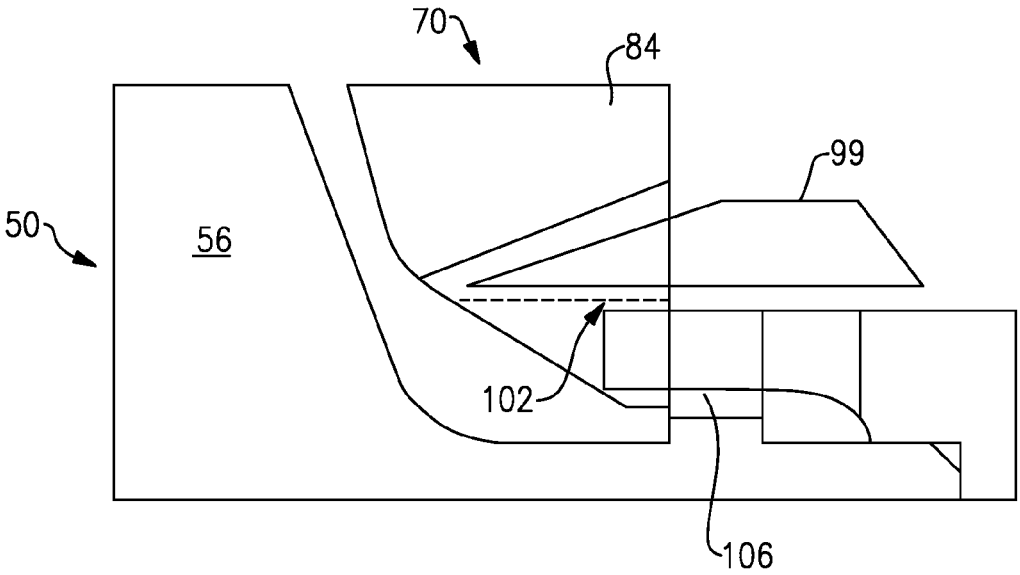
FIG. 6 illustrates a tool for installing a cover plate to a gas turbine engine rotor assembly.

FIG. 6 schematically illustrates the use of a tool 99 for installing a cover plate 70 to a rotor assembly 50. The angled slots 102 of the cover plate 70 allow the tool 99 to be inserted from the side of the outer surface 88 of the cover plate 70 without blocking the disk tabs 106. The tool 99 is insertable between the tabs 100 and can be used to rotate the cover plate 70 during installation or removal.

Figure 7:
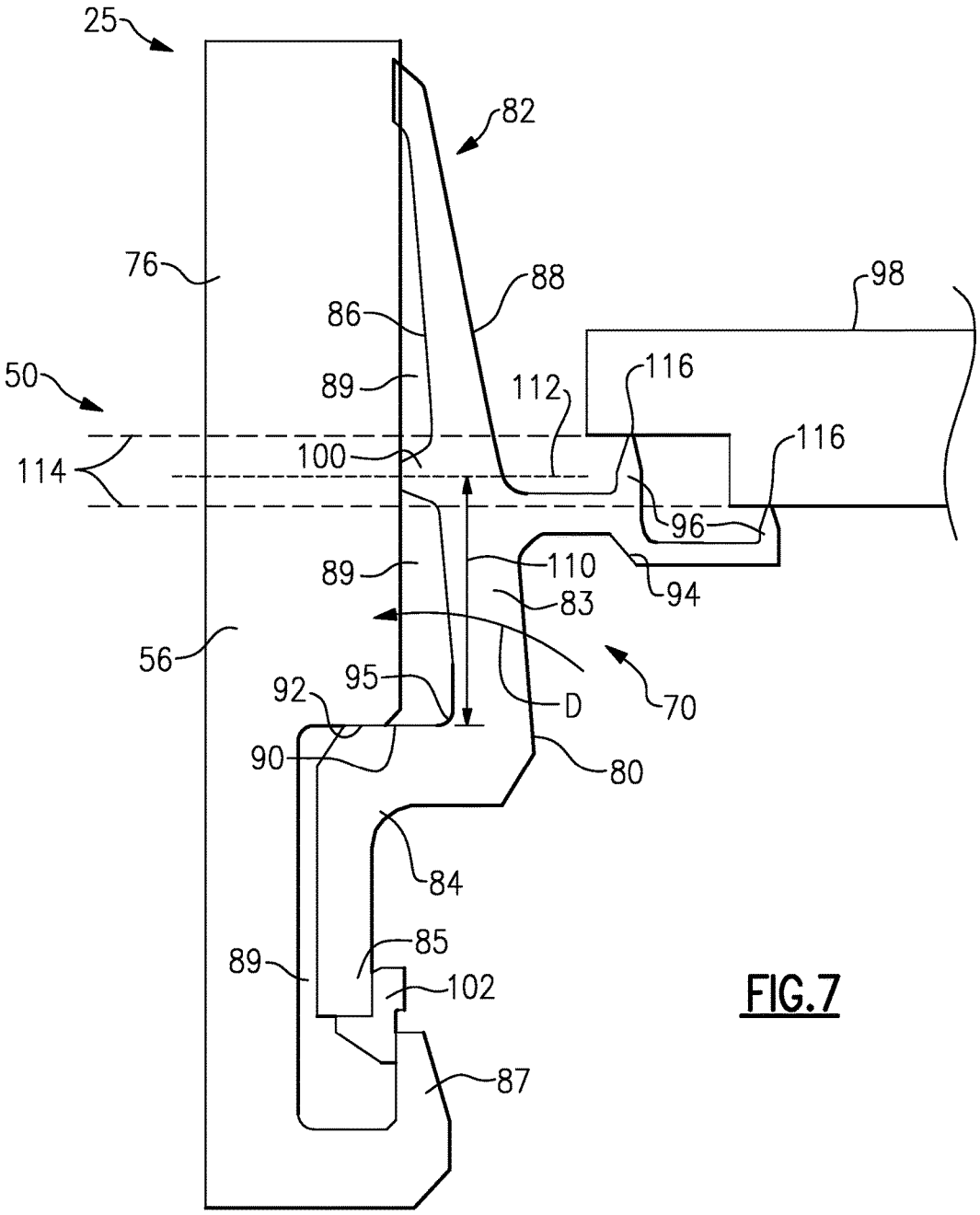
FIG. 7 illustrates another cover plate.

FIG. 7 illustrates another exemplary cover plate 70 that may be incorporated into a rotor assembly 50. The cover plate 70 includes a body 80 having a mid-section 83 that extends between a radially outer portion 82 and a retaining leg 84. In one embodiment, the body 80 is an annular structure (i.e., a full ring hoop).

The retaining leg 84 is generally opposite the radially outer portion 82 and extends to an inner diameter portion 85. A retaining ring 102 may engage the inner diameter portion 85 of the cover plate 70 to axially secure the cover plate 70 to the rotor assembly 50. In one embodiment, the retaining ring 102 engages both the inner diameter portion 85 of the cover plate 70 and a flange 87 of the rotor disk 56.

The body 80 axially extends between an inner face 86 (which faces toward the blade 25 and the rotor disk 56) and an outer face 88 (which faces away from the blade 25 and rotor disk 56). Cavities 89 may extend between the inner face 86 of the cover plate 70 and a root 76 of a blade 25 or rotor disk 56 of the rotor assembly 50.

The retaining leg 84 may include one or more radial retention features 90 that limit radial deflection between the cover plate 70 and the rotor disk 56. In one embodiment, the retaining leg 84 extends from the body 80 such that the retention feature 90 engages an inner diameter surface 92 of the rotor disk 56 to provide radial interference between the cover plate 70 and the rotor disk 56.

The cover plate 70 may additionally include a seal land 94 that axially extends from the outer face 88 of the body 80. The seal land 94 includes one or more seals 96, such as knife edge seals, that seal relative to a static structure 98. In one embodiment, the static structure 98 is part of an adjacent stator assembly (see for example, the stator assembly 52 of FIG. 2). The seal land 94 is radially outward of the retaining leg 84, in one embodiment.

A fillet 95 connects the mid-section 83 of the body 80 to the retaining leg 84. A bumper 100 extends from the inner face 86 of the body 80 of the cover plate 70 in a direction away from the outer face 88. In one embodiment, the bumper 100 extends from the mid-section 83 of the body 80. The bumper 100 may contact the rotor disk 56 (or root 76 of blade 25) to limit a deflection D of the body 80 toward the rotor disk 56 (i.e., axial movement of the body 80 in a direction that extends from the outer face 88 toward the inner face 86), thereby reducing stresses of the fillet 95. The cover plate 70 could include additional bumpers than are shown in FIG. 7.

In one embodiment, the bumper 100 is located radially outward of the fillet 95. The fillet 95 and the bumper 100 may be radially offset by a distance 110. The distance 110 may vary depending on certain design criteria, such as the size of the fillet 95, among other factors. The bumper 100 may be positioned anywhere between the fillet 95 and the radially outer portion 82.

In another embodiment, the bumper 100 is radially between the seals 96 of the seal land 94. For example, a plane 112 that extends axially through a middle of the bumper 100 may extend radially between planes 114 that axially extend across radially outer surfaces 116 of the seals 96.

Although the different non-limiting embodiments are illustrated as having specific components, the embodiments of this disclosure are not limited to those particular combinations. It is possible to use some of the components or features from any of the non-limiting embodiments in combination with features or components from any of the other non-limiting embodiments.

It should be understood that like reference numerals identify corresponding or similar elements throughout the several drawings. It should also be understood that although a particular component arrangement is disclosed and illustrated in these exemplary embodiments, other arrangements could also benefit from the teachings of this disclosure.

The foregoing description shall be interpreted as illustrative and not in any limiting sense. A worker of ordinary skill in the art would understand that certain modifications could come within the scope of this disclosure. For these reasons, the following claims should be studied to determine the true scope and content of this disclosure.

What is claimed is:

1. A cover plate, comprising:

a body, wherein said body includes at least one radial retention feature extending from an inner face of said body;

a first tab near a bore of said body;

a second tab circumferentially spaced from said first tab;

a slot defined between said first tab and said second tab, said first tab, said second tab and said slot extending at an angle relative to a slot axis that extends through said bore; and wherein said radial retention feature extends axially forward from an axially forward surface of said inner face that is radially inward of said radial retention feature.

2. The cover plate as recited in claim 1, wherein said cover plate is part of a turbine rotor assembly or a compressor rotor assembly.

3. The cover plate as recited in claim 1, wherein an outer face of said first tab and said second tab is offset from an outer face of said body.

4. The cover plate as recited in claim 1, comprising a seal land that extends from said body.

5. The cover plate as recited in claim 4, wherein said seal land includes at least one seal that seals against a static structure adjacent to said body.

6. The cover plate as recited in claim 1, wherein said slot extends radially outward from a base of said first tab and said second tab.

7. The cover plate as recited in claim 1, wherein each of said first tab and said second tab include a gradually decreasing thickness in a direction toward a tip of each of said first tab and said second tab.

8. The cover plate as recited in claim 1, wherein an inner surface of said first tab and said second tab extends at said angle.

9. A cover plate, comprising:

a body axially extending between an inner face and an outer face;

a retaining leg that extends to an inner diameter portion of said body;

a fillet that extends between said body and said retaining leg;

a seal land including an arm extending axially from an outer face of said seal body and a first seal and a second seal extending radially outward from said arm;

a bumper that extends from said inner face at a location radially outward from said fillet and radially between said first seal and said second seal to limit deflection of said body; and wherein a bumper plane extends axially through a middle of said bumper, a first seal plane extends axially across a radially outer surface of said first seal, a second seal plane extends axially across a radially outer surface of said second seal, and said bumper plane extends radially between said first seal plane and said second seal plane.

10. The cover plate as recited in claim 9, wherein said bumper is disposed on a mid-section of said body.

11. The cover plate as recited in claim 9, wherein said bumper is radially offset from said fillet by a distance.

12. A gas turbine engine, comprising:

a rotor section rotatable about an axis and including a rotor disk having an inner diameter surface;

a cover plate including a body, a radial retention feature extending from an axially forward surface of said body and providing radial interference with said inner diameter surface, wherein said axially forward surface is radially inward of said radial retention feature with respect to said axis, a first tab near a bore of said body, a second tab circumferentially spaced from said first tab, and a slot defined between said first tab and said second tab, said first tab, said second tab and said slot extending at an angle relative to a slot axis that extends through said bore, a blade having a blade root received at a radially outer end of said rotor disk, wherein a radially outer portion of said cover plate is configured to engage and axially retain said blade, wherein said blade root, a radially outer surface of said radial retention feature, and said body at least partially form a first cavity; and wherein said rotor disk, a radially inner surface of said radial retention feature, and said axially forward surface radially inward of said radial retention feature at least partially provide a second cavity.

13. The gas turbine engine as recited in claim 12, comprising a stator section axially aft of said rotor section, wherein a seal land axially extends from an aft face of said body and is configured to seal relative to said stator section.

14. The gas turbine engine as recited in claim 13, wherein said seal land is radially outward of said radial retention feature.

15. The gas turbine engine as recited in claim 12, wherein a seal land axially extends from an aft face of said body and is radially outward of said radial retention feature.

* * * * *